US005899090A

United States Patent [19]

Lyu

[11] Patent Number: 5,899,090

[45] Date of Patent: May 4, 1999

[54] REFRIGERATOR HAVING AN APPARATUS FOR DISTRIBUTING A CHILLED AIR

[75] Inventor: Gang Lyu, Incheon, Rep. of Korea

[73] Assignee: Daewoo Electronics Co., Ltd., Seoul, Rep. of Korea

[21] Appl. No.: 08/994,653

[22] Filed: Dec. 19, 1997

[30] Foreign Application Priority Data

Jul. 31, 1997 [KR] Rep. of Korea ..... 97-36445

[51] Int. Cl.[6] ..... F25D 17/08; F25D 17/04; F25B 5/00

[52] U.S. Cl. ..... 62/408; 62/283; 62/187

[58] Field of Search ..... 62/407, 408, 441, 62/283, 187

[56] References Cited

U.S. PATENT DOCUMENTS

| | | | |
|---|---|---|---|
| 4,077,229 | 3/1978 | Gelbard et al. | 62/441 |
| 4,614,092 | 9/1986 | Kim et al. . | |
| 4,920,758 | 5/1990 | Janke et al. | 62/408 |
| 5,092,136 | 3/1992 | Kang et al. | 62/408 |

*Primary Examiner*—Henry Bennett
*Assistant Examiner*—Melvin Jones
*Attorney, Agent, or Firm*—Pillsbury Madison & Sutro LLP

[57] ABSTRACT

A refrigerator having an apparatus for distributing a chilled air. The apparatus has an impeller for sucking and impelling the chilled air generated by an evaporator, a chilled air distributing member for properly distributing the chilled air impelled by the impeller into ducts communicated with a freezer and refrigerating compartments, and motors for driving the impeller and the chilled air distributing member. The chilled air distributing member is formed at a circumferential outer wall thereof with an opening so as to control an amount of the chilled air flowing into the ducts respectively when the member rotates. The refrigerator can effectively distribute a chilled air generated from an evaporator, thereby properly maintaining temperatures of the freezer and refrigerating compartments. Since the refrigerator has only one fan, an inner structure inside of a space section is simple so that the refrigerator can be easily produced and assembled.

7 Claims, 2 Drawing Sheets

REFRIGERATOR HAVING AN APPARATUS FOR DISTRIBUTING A CHILLED AIR

BACKGROUND OF THE INVENTION

1. Field of the Invention

The present invention relates to a refrigerator, and more particularly to a refrigerator which can effectively distribute a chilled air into a freezer compartment and a refrigerating compartment.

2. Description of the Prior Art

Generally, a refrigerator is a device for storing foodstuffs at a relatively low temperature in order to maintain a freshness of the foodstuff. The refrigerator comprises a compressor, a condenser, an expansion valve and an evaporator. It is common knowledge that a working fluid called as a refrigerant circulates through a thermodynamic cycle. In such systems, a low pressure refrigerant is compressed by the compressor and leaves the compressor as a vapor with an elevated pressure, and then condenses in the condenser, resulting in a transfer of a heat to an environment surrounding the condenser. A high pressure liquid refrigerant then passes through the expansion valve in which some of the liquid refrigerant flashes into vapor. The remaining refrigerant is vaporized in the low pressure evaporator, resulting in a transfer of a heat to the evaporating refrigerant from the environment, thereby cooling a surrounding air. The chilled air generated at a periphery of the evaporator is blown into a freezer compartment by a fan. The refrigerant vapor is then drawn into the compressor, and the cycle begins again. In short, in the evaporator, the refrigerant absorbs a heat from the surroundings and, in the condenser, it gives a heat off.

FIG. 1 shows a conventional refrigerator 100.

As shown in FIG. 1, refrigerator 100 comprises a cabinet 110. Cabinet 110 is formed therein with a refrigerating compartment 130 for receiving foodstuffs which are to be maintained fresh at a relatively low temperature and a freezer compartment 120 for receiving foodstuffs which are to be maintained in a frozen state. Freezer compartment 120 is formed at a rear portion thereof with a space section 140 in which an evaporator 160 for generating a chilled air is installed. Freezer compartment 120 and space section 140 are divided by a wall section 150.

A compressor (not shown) is in stalled below refrigerating compartment 130 for compressing and circulating the refrigerant. The vapor-phase refrigerant with high pressure and high temperature which has passed through the compressor gives a heat to a surroundings in the condenser (not shown), and is condensed into liquid phase. The liquid-phase refrigerant then passes through the expansion valve(not shown) in which some of the liquid-phase refrigerant flashes into vapor. The remaining refrigerant is vaporized in the low pressure evaporator 160 installed at a predetermined position in space section 140, resulting in a transfer of a heat to the evaporating refrigerant from the environment, thereby cooling a surrounding air.

Wall section 150 is formed at an upper portion thereof with a first duct 155 for introducing the chilled air generated by the evaporator into freezer compartment 120. A first fan 180 driven by a first motor 182 is installed in space section 140 at a position corresponding to a position of first duct 155, for smoothly blowing a portion of the chilled air generated at a periphery of evaporator 160 into freezer compartment 120. The rest of the chilled air is blown by a second fan 184 driven by a second motor 186 and flows into refrigerating compartment 130 through a second duct 145 formed in a rear wall of cabinet 110.

The chilled air flown into refrigerating and freezer compartments 130 and 120 absorbs a heat from stored foodstuffs and returns to space section 140 through return passages 135 and 125 formed at a wall section 152 so as to be cooled again in the above-described manner.

In conventional refrigerator 100, a plurality of fans are required in order to blow the chilled air generated by evaporator 160 into first and second ducts 155 and 145 so that an inner structure of space section 140 is complicated. Also, a respective amount of the chilled air flowing into freezer and refrigerating compartments 120 and 130 cannot be controlled, so the temperatures of freezer and refrigerating compartments 120 and 130 are not properly maintained.

On the other hand, U.S. Pat. No. 4,614,092 issued to Kim et al. discloses a device for controlling an amount of a chilled air flowing into a refrigerating compartment by providing a control plate at a duct communicated with the refrigerating compartment. However, when the chilled air is flowing into the refrigerating compartment, the chilled air collides with the control plate so as to shift a position of the control plate, so the amount of the chilled air cannot be properly controlled.

SUMMARY OF THE INVENTION

The present invention is intended to overcome the above described disadvantage.

Therefore, it is an object of the present invention to provide a refrigerator having an apparatus for distributing a chilled air which can effectively distribute the chilled air into freezer and refrigerating compartments.

In order to achieve the above object of the present invention, there is provided a refrigerator comprising:

a cabinet having a refrigerating compartment, a freezer compartment formed at an upper portion of the refrigerating compartment, and a space section formed at a rear portion of the freezer compartment and separated from the freezer compartment by a first partition wall which is formed at a predetermined position thereof with a first duct, the cabinet being formed at a predetermined position of a rear wall thereof with a second duct for communicating the space section with the refrigerating compartment;

an evaporator for generating a chilled air, the evaporator being installed at a predetermined position of the space section;

a first means for sucking and impelling the chilled air generated by the evaporator;

a second means for controlling a quantity of the chilled air which is impelled by the first means and flows into the first and second ducts; and a third means for driving the second means.

The space section is divided into a first space and a second space by a second partition wall, the first space being formed below the second partition wall, and the first and second ducts being communicated with the first space.

According to the preferred embodiment of the present invention, the second partition wall is made of an adiabatic material so as to prevent a heat from transferring between the first and second spaces.

The first means includes a first motor secured to a lower portion of the second space, a first motor shaft downwardly extending from the first motor by passing through a first hole formed at a predetermined position of the second partition wall, and an impeller which sucks the chilled air from a periphery of the evaporator and radially and outwardly impels the chilled air, the impeller being coupled to an edge portion of the first motor shaft and being located above the evaporator.

The second means includes a chilled air distributing member which has a hollow cylindrical shape with a bottom part thereof opened, the chilled air distributing member being disposed around a predetermined position of the first motor shaft and surrounding the impeller in such a manner that the chilled air distributing member is radially spaced apart from the impeller by a predetermined distance, and the chilled air distributing member being formed at a circumferential outer wall thereof with at least one opening.

According to the preferred embodiment of the present invention, the opening is larger than a half of the circumferential wall of the chilled air distributing member.

A ball bearing is provided between the first motor shaft and the chilled air distributing member so that the chilled air distributing member is maintained stationary when the first motor shaft rotates.

The third means includes a second motor secured to the lower portion of the second space, a second motor shaft downwardly extending from the second motor by passing through a second hole formed at a predetermined position of the second partition wall, a first gear fixedly assembled to an edge portion of the second motor shaft, and a second gear fixedly attached to a top surface of the chilled air distributing member, the second gear being concentrically disposed with the chilled air distributing member and being engaged with the first gear.

According to the preferred embodiment of the present invention, the second motor is a step motor.

The third means is electrically connected to an ECU (Electronic Control Unit), and when temperature sensors placed in the freezer and refrigerating compartments send data to the ECU, the ECU sends an operating signal to the third means so as to rotate the second means.

The refrigerator having an apparatus for distributing a chilled air according to the present invention can effectively distribute a chilled air generated from an evaporator, thereby properly maintaining temperatures of freezer and refrigerating compartments.

In addition, since the refrigerator according to the present invention has only one fan, an inner structure inside of a space section is simple so that the refrigerator can be easily produced and assembled.

BRIEF DESCRIPTION OF THE DRAWINGS

The above object and other advantages of the present invention will become more apparent by describing in detail a preferred embodiment thereof with reference to the attached drawings in which.

DETAILED DESCRIPTION OF THE INVENTION

Hereinafter, a refrigerator 200 having an apparatus for distributing a chilled air according to a preferred embodiment of the present invention will be explained in more detail with reference to the accompanying drawings.

Elements which are the same as conventional elements will be referred to with the same numerals.

Figure 1:
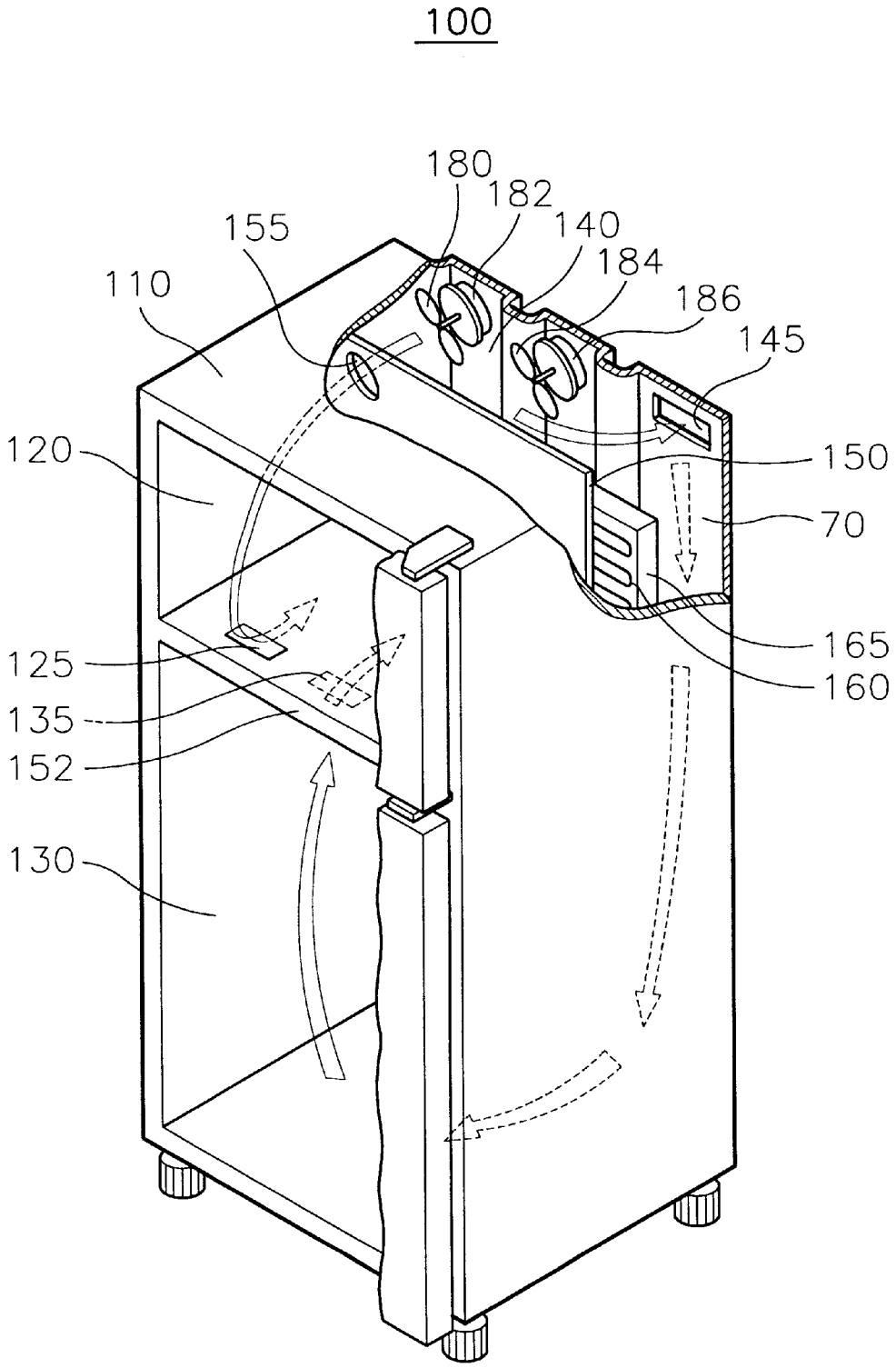
FIG. 1 (PRIOR ART)
FIG. 1 is a perspective view showing an inner structure of a conventional refrigerator.
Figure 2:
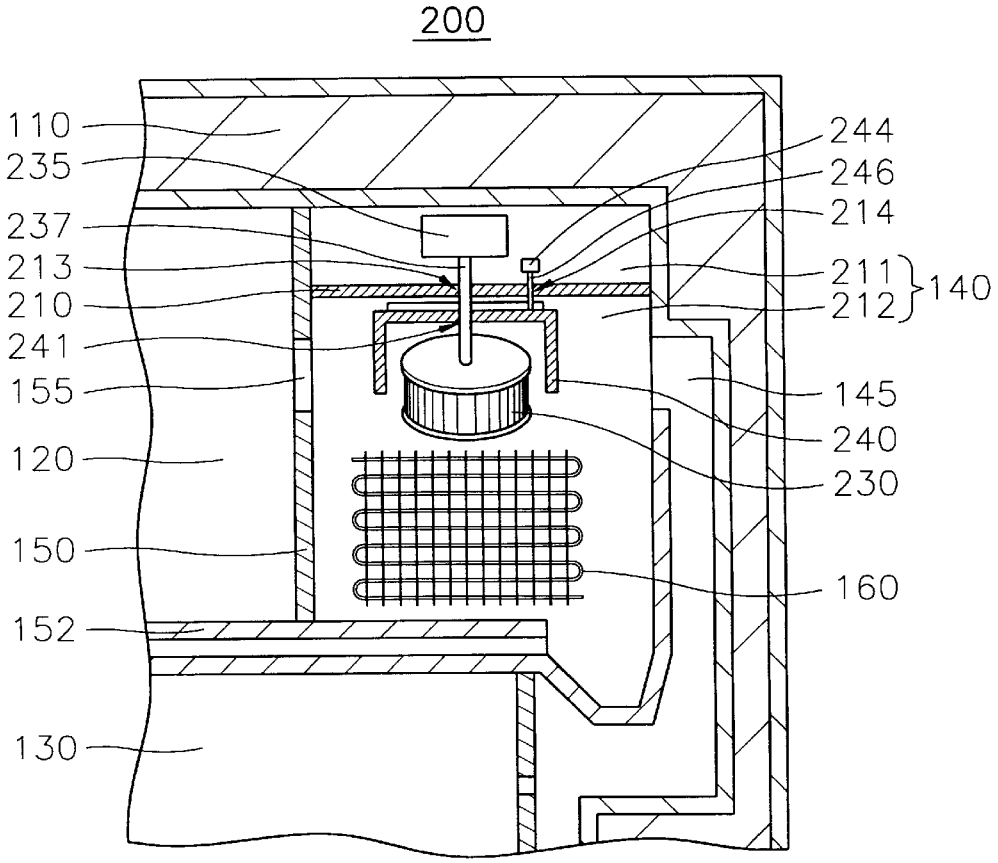
FIG. 2 is a side cross-sectional view showing an inner structure of a space section of a refrigerator according to the present invention.

FIG. 2 is an enlarged view showing an inner structure of a space section 140 of a refrigerator 200 having an apparatus for distributing a chilled air 202 according to the present invention.

As shown in FIG. 2, refrigerator 200 comprises a cabinet 110. Cabinet 110 is formed therein with a refrigerating compartment 130 for receiving foodstuffs which are to be maintained fresh at a relatively low temperature and a freezer compartment 120 for receiving foodstuffs which are to be maintained in a frozen state. Freezer compartment 120 is formed at a rear portion thereof with a space section 140, in which an evaporator 160 for generating a chilled air is installed. Refrigerating and freezer compartments 130 and 120 are divided by a wall section 152, and freezer compartment 120 and space section 140 are divided by a first partition wall 150.

First partition wall 150 is formed at an upper portion thereof with a first duct 155 so as to introduce the chilled air generated by evaporator 160 into freezer compartment 120. Cabinet 110 is formed at a predetermined position of a rear wall thereof with a second duct 145 for communicating space section 140 with refrigerating compartment 130 so as to allow the chilled air to flow into refrigerating compartment 130.

Space section 140 is divided into a first space 211 and a second space 212 by a second partition wall 210. First space 211 is formed below second partition wall 210 and second space 212 is formed above second partition wall 210. Second space 212 separately receives heat radiating devices such as a motor, and second partition wall 210 is made of an adiabatic material so as to prevent a heat from transferring between first and second spaces 211 and 212. First and second ducts 155 and 145 are communicated with first space 211.

As a means for sucking and impelling the chilled air generated by evaporator 160, an impeller 230 is provided above evaporator 160 in space section 140, sucks the chilled air from a periphery of evaporator 160, and radially and outwardly impels the chilled air. A first motor 235 is secured to a lower portion of second space 212 in order to drive impeller 230, and a first motor shaft 237 downwardly extends from first motor 235 and passes through a first hole 213 formed at a predetermined position of second partition wall 210 such that impeller 230 is coupled to an edge portion of first motor shaft 237.

The chilled air impelled by impeller 230 is separately flowed into first and second ducts 155 and 145 by a chilled air distributing member 240, and an amount of the chilled air flowing into first and second ducts 155 and 145 is controlled by a rotation of chilled air distributing member 240.

Figure 3:
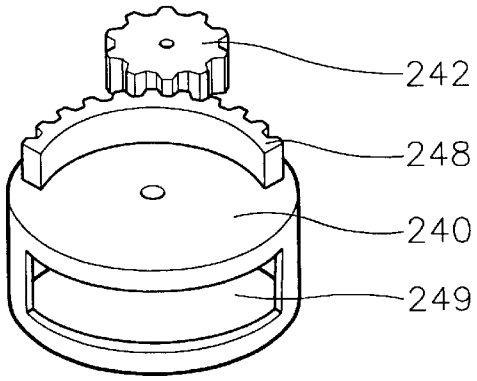
FIG. 3 is a perspective view showing a mechanism for driving the apparatus for distributing a chilled air according to the present invention.

Chilled air distributing member 240 has a hollow cylindrical shape with a bottom part thereof opened and is disposed around a predetermined position of first motor shaft 237. A ball bearing 241 is provided between first motor shaft 237 and chilled air distributing member 240 so that chilled air distributing member 240 is maintained stationary when first motor shaft 237 rotates. Chilled air distributing member 240 is downwardly opened so as to allow the chilled air to flow thereinto and, as shown in FIG. 3, surrounds impeller 230 in such a manner that chilled air distributing member 240 is radially spaced apart from impeller 230 by a predetermined distance. Chilled air distributing member 240 is formed at a circumferential outer wall thereof with an opening 249 larger than a half of the circumferential wall thereof. When chilled air distributing member 240 rotates, a position of opening 249 is changed so that a respective amount of the chilled air impelled by impeller 230 and flowing into first and second ducts 155 and 145 can be controlled.

As a means for rotating chilled air distributing member 240, a second gear 248 is fixedly and concentrically attached to a top surface of chilled air distributing member 240. Second motor 244 is secured to the lower portion of second space 211 and a second motor shaft 246 downwardly extends from second motor 244 by passing through a second hole 214 formed at a predetermined position of second partition wall 210. First gear 242 is fixedly assembled to an edge portion of second motor shaft 246 and is engaged with second gear 248.

Preferably, second motor 244 is a step motor so as to minutely rotate chilled air distributing member 244. Second motor 244 is electrically connected to an ECU (Electronic Control Unit) (not shown), and when temperature sensors (not shown) placed in freezer and refrigerating compartments 120 and 130 send data to the ECU, the ECU sends an operating signal to second motor 244 so as to properly rotate chilled air distributing member 240.

The refrigerator having an apparatus for distributing a chilled air according to the present invention can effectively distribute a chilled air generated from an evaporator, thereby properly maintaining temperatures of freezer and refrigerating compartments.

In addition, since the refrigerator according to the present invention has only one fan, an inner structure inside of a space section is simple so that the refrigerator can be easily produced and assembled.

Although the preferred embodiment of the invention has been described, it is understood that the present invention should not be limited to this preferred embodiment, but various changes and modifications can be made by one skilled in the art within the spirit and scope of the invention as hereinafter claimed.

What is claimed is:

1. A refrigerator comprising:

a cabinet having a refrigerating compartment, a freezer compartment formed at an upper portion of the refrigerating compartment, and a space section formed at a rear portion of the freezer compartment and separated from the freezer compartment by a first partition wall which is formed at a predetermined position thereof with a first duct, the cabinet being formed at a predetermined position of a rear wall thereof with a second duct for communicating the space section with the refrigerating compartment, the space section being divided into a first space and a second space by a second partition wall made of an adiabatic material for blocking heat-transfer between the first and second spaces, the first space being located below the second partition wall and the first and second ducts being communicated with the first space;

an evaporator for generating a chilled air, the evaporator being installed at a predetermined position of the space section;

a first means for sucking and impelling the chilled air generated by the evaporator;

a second means for controlling a quantity of the chilled air which is impelled by the first means and flows into the first and second ducts; and a third means for driving the second means.

2. The refrigerator according to claim 1, wherein the first means includes a first motor secured to a lower portion of the second space, a first motor shaft downwardly extending from the first motor by passing through a first hole formed at a predetermined position of the second partition wall, and an impeller which sucks the chilled air from a periphery of the evaporator and radially and outwardly impels the chilled air, the impeller being coupled to an edge portion of the first motor shaft and being located above the evaporator.

3. The refrigerator according to claim 2, wherein the second means includes a chilled air distributing member which has a hollow cylindrical shape with a bottom part thereof opened, the chilled air distributing member being disposed around a predetermined position of the first motor shaft and surrounding the impeller in such a manner that the chilled air distributing member is radially spaced apart from the impeller by a predetermined distance, and the chilled air distributing member being formed at a circumferential outer wall thereof with at least one opening.

4. The refrigerator according to claim 3, wherein the opening is larger than a half of the circumferential wall of the chilled air distributing member.

5. The refrigerator according to claim 3, wherein a ball bearing is provided between the first motor shaft and the chilled air distributing member so that the chilled air distributing member is maintained stationary when the first motor shaft rotates.

6. The refrigerator according to claim 3, wherein the third means includes a second motor secured to the lower portion of the second space, a second motor shaft downwardly extending from the second motor by passing through a second hole formed at a predetermined position of the second partition wall, a first gear fixedly assembled to an edge portion of the second motor shaft, and a second gear fixedly attached to a top surface of the chilled air distributing member, the second gear being concentrically disposed with the chilled air distributing member and being engaged with the first gear.

7. The refrigerator according to claim 6, wherein the second motor includes a step motor.

* * * * *